US005401181A

United States Patent [19]

Wilson

[11] Patent Number: 5,401,181

[45] Date of Patent: Mar. 28, 1995

[54] CONNECTOR WITH FLUID SEALING

[75] Inventor: Daniel P. Wilson, Fontana, Calif.

[73] Assignee: D S M & T Co., Inc., Fontana, Calif.

[21] Appl. No.: 47,676

[22] Filed: Apr. 15, 1993

[51] Int. Cl.[6] ..... H01R 13/52

[52] U.S. Cl. ..... 439/281; 439/678

[58] Field of Search ..... 439/276, 278, 281, 283, 439/586, 587; 29/856, 857, 858

[56] References Cited

U.S. PATENT DOCUMENTS

| | | | |
|---|---|---|---|
| 2,037,630 | 4/1936 | Hudson | 439/281 |
| 2,782,391 | 2/1957 | Kirk | 439/281 X |
| 3,107,132 | 10/1963 | Smith | 439/281 X |
| 3,601,761 | 8/1971 | Harris | 439/281 X |
| 4,601,529 | 7/1986 | Billet | 439/281 |
| 4,904,198 | 2/1990 | Begitschke et al. | 439/281 |
| 5,158,479 | 10/1992 | Mouissie . | |

*Primary Examiner*—Khiem Nguyen
*Attorney, Agent, or Firm*—Collard & Roe

[57] ABSTRACT

A connector with fluid sealing including a male connector part having a rectangular body containing at least one contact pin. The outer peripheral surfaces of the rectangular body forming a male mating area. The connector further includes a female mating part containing at least one contact receptacle and having a rectangular opening adapted to receive the male connector part within the opening. The inner peripheral surfaces of the female connector part defining the rectangular opening forming a female mating area. A bead extends circumferentially around the entire periphery of one of the mating areas. The other of the mating areas has a groove extending circumferentially around the entire periphery and is adapted to receive the bead to create a fluid seal between the male and female connector parts.

14 Claims, 1 Drawing Sheet

CONNECTOR WITH FLUID SEALING

BACKGROUND OF THE INVENTION

1. Field of the Invention

The present invention relates to a connector with fluid sealing. More particularly, it relates to a connector with a male and female parts in which a bead and a corresponding groove are formed on respective male and female mating areas.

2. The Prior Art

Connectors are known for coupling and uncoupling electrical cables. Connectors for outdoor applications frequently require a separate rubber or plastic gasket to obtain a moisture-proof seal. It would be advantageous to combine the gasket with the connector parts to reduce the number of parts and simplify the mating of the connector parts. The reduction of the number of parts makes it possible to produce the connector more inexpensively and makes mating easier.

One such attempt at providing a connector with fluid seals is the U.S. Pat. to Mouissie No. 5,158,479, which discloses a connector having hard sawtooth-shaped collars that engage with and penetrate the smooth resilient mating face of the opposed connector part. However, the sawtooth-shaped collars, which deform the opposed mating surface, makes it difficult to disconnect the connector parts. Accordingly, it would be advantageous to have a connector with fluid sealing that can be easily connected and disconnected without damaging either connector part. In addition, the prior art connector requires both a hard and a resilient material to manufacture the connector. Therefore, it would be desirable to have a connector with fluid sealing that is made from a single material.

SUMMARY OF THE INVENTION

It is therefore an object of the present invention to overcome the drawbacks of the prior-art and to provide a connector which can be readily connected to provide fluid sealing.

It is a further object of the present invention to provide a connector wherein the opposed mating areas have corresponding profiles.

It is still another object of the present invention to provide a connector wherein one mating area is provided with a bead and the other mating area has a groove adapted to receive the bead.

It is a further object of the present invention to provide a connector where both mating areas are made from the same material.

It is yet another object of the present invention to provide a connector in which the bead is seated within the groove in the coupled connector to provide fluid sealing.

These and other related objects are achieved according to the invention by a connector with fluid sealing between mated parts. The connector includes a male connector part having a rectangular body containing at least one contact pin. The outer peripheral surfaces of the rectangular body form a male mating area. The connector additionally includes a female connector part containing at least one contact receptacle and a rectangular opening adapted to receive the male connector part within the opening. The inner peripheral surfaces of the female connector part, defining the rectangular opening, form a female mating area. A bead extends circumferentially around the entire periphery of one of the male and female mating areas. The other of the male and female mating areas has a groove extending circumferentially around the entire periphery adapted to receive the bead to create a fluid seal between the male and female connector parts.

The male and female connector parts are movable along a mating axis to connect and disconnect the at least one contact pin and the at least one contact receptacle. The male and female mating areas are oriented parallel to the mating axis. The bead includes a bead height measured transverse to the mating axis. The groove includes a groove depth which is approximately equal to the bead height. The bead has a bead width measured parallel to the mating axis. The groove has a groove width which is slightly larger than the bead width. The male mating area has a male mating area length measured in a direction parallel to the mating axis. The female mating area has a female mating area length which is approximately equal to the male mating area length. The male mating area has an end facing the at least one contact receptacle. The fluid seal is located substantially away from the end.

The male mating area includes a first region located between the fluid seal and the end and a second region located on the opposite side of the fluid seal. The first region has a first region length measured in a direction parallel to the mating axis, and the second region has a second region length measured in the direction parallel to the mating axis that is less than half of the first region length. The bead width is approximately 1½ times the bead height. The first region length is approximately four times the bead width. The groove width is approximately twice the length of the groove depth.

BRIEF DESCRIPTION OF THE DRAWINGS

Other objects and features of the present invention will become apparent from the following detailed description considered in connection with the accompanying drawing which discloses an embodiment of the present invention. It should be understood, however, that the drawing is are designed for the purpose of illustration only and not as a definition of the limits of the invention.

In the drawing, wherein similar reference characters denote similar elements throughout the several views.

DETAILED DESCRIPTION OF PREFERRED EMBODIMENT

Figure 1:
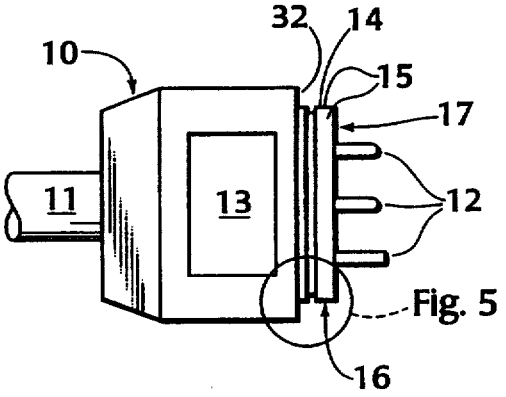
FIG. 1 is a top plan view of an embodiment of a male connector part according to the invention.

Referring now to the drawings and, in particular, FIG. 1, there is shown a male connector part 10 attached to the end of a wire 11. Wire 11 may contain one or more insulated conductors, for example, four insulated conductors. Each conductor is internally connected to one of the contact pins 12 (see FIG. 3). Male connector part 10 includes a molded housing 13 and a rectangular body 14 from which contact pins 12 extend. Rectangular body 14 consists of four outer peripheral surfaces 15 which together form a male mating area 16. Male mating area 16 has a height 17 which is 0.200 inches, for example.

Figure 2:
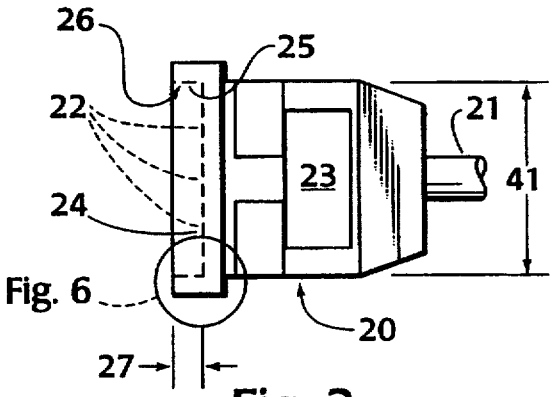
FIG. 2 is a top plan view of an embodiment of a female connector part according to the invention.

Referring now to FIG. 2, there is shown a female connector part 20 connected to the end of a wire 21. Wire 21 preferably has the same number of insulated conductors as contained in wire 11. Contact receptacles 22 are located within a molded housing 23 and are electrically coupled to separate conductors of wire 21. Contact receptacles 22 are arranged to receive contact pins 12 of male connector part 10. Housing 23 forms a rectangular opening 24 having inner peripheral surfaces 25. The inner peripheral surfaces collectively define a female mating area 26. Female mating area 26 has a depth 27, which is, for example, 0.200 inches that is equal to height 17.

Figure 3:
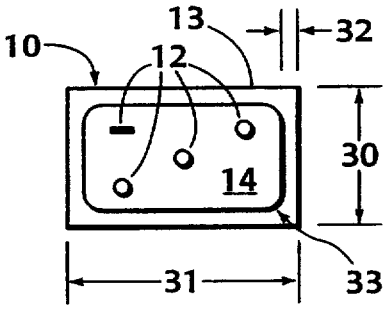
FIG. 3 is a right side elevational view of the male connector part.

Referring now to FIG. 3, male connector part 10 is shown with contact pins 12 facing out of the page. Housing 13 has an overall height 30 and an overall width 31 which are 0.720 inches and 1.250 inches, respectively, for example. A border 32 of 0.100 inches, for example, borders rectangular body 14. Rectangular body 14 includes corners 33 that have a 0.125 radius of curvature, for example.

Figure 4:
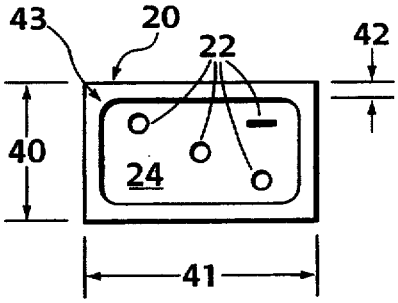
FIG. 4 is a left side elevational view of the female connector part.

As can be seen in FIG. 4, female connector part 20 has an overall height 40 and an overall width 41 that is approximately equal to overall height 30 and overall length 31 of male connector part 10. Receptacles 22 are shown extending into the page. Female connector part 20 includes a lip 42 which extends out of the page to define rectangular opening 24. Lip 42 has a width of 0.100 inches, for example. Lip 42 includes four interior facing corners 43 having a radius of curvature of 0.125 inches. The exceedingly small outer dimensions of the connector parts 10 and 20 allow them to be used in a variety of applications where larger connectors could not fit. For example, in the spa industry, there is a need for a waterproof or splashproof connector that is small enough to be located in narrow passageways where larger conventional connectors cannot fit.

Figure 5:
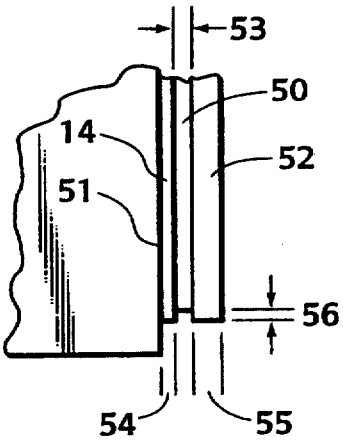
FIG. 5 is an enlarged view of the male mating area.

As can be seen in FIG. 5, there is an enlarged view of rectangular body 14. A groove 50 is located between a first section 51 and a second section 52. Groove 50 has a width 53 of 0.040 inches, for example. First section 51 has a width 54 of 0.115 inches and second section 52 has a width 55 of 0.045 inches, for example. Groove depth 56 is 0.020 inches, for example.

Figure 6:
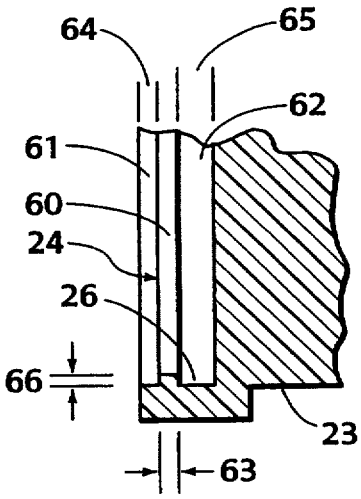
FIG. 6 is an enlarged cross-sectional view of the female mating area.

FIG. 6 is an enlarged cross-sectional view taken from FIG. 2 which shows a bead 60 having a width 63 of 0.030 inches, for example. Bead 60 is located between a first section 61 having a width 64 of 0.050 inches, for example, and a second section 62 having a width 65 of 0.120 inches, for example. Bead height 66 is 0.020 inches, for example.

Female mating area 26 is made of a resilient rubber or plastic material. Initially, first section 61 comes into contact with second section 52. Thereafter, bead 60, which will fit snugly within the groove 50, passes over second section 52. Female mating area 26 expands slightly and when sections 61 and 62 come into overlapping relationship with sections 51 and 52, bead 60 snaps into groove 50 under the restoring force of female mating area 26. The height 66 of bead 60 and the depth 56 of groove 50 are approximately equal, so that a water and vapor seal is achieved between contact pins 12, receptacles 22, and the external environment.

It should be noted that male connector part 10 and female connector part 20 can be equipped with a variety of configurations of contact pins and receptacles. For example, two or three contact pins could be attached to male connector part 10. The negative or ground contact pin is generally a flat contact, with the hot contact pins having a generally circular cross section. A set of corresponding receptacles can then be provided on female connector part 20. The orientation and internal connections between the contact pins and the receptacles and wires 11 and 21, would ensure that the ground conductor within wire 11 would be connected to the ground conductor within wire 21, and that the one or more hot leads within wire 11 would be appropriately coupled to the hot leads within wire 21.

Male connector part 10 and female connector part 20 can be manufactured in a simple and efficient manner according to the following steps.

First, the wire leads or cords are cut and stripped to customer specifications. The wire leads are UL recognized components and the cords are UL listed components.

Second, terminals are attached to the wire leads or cords using crimp bench presses and terminal applicators, suitable for type of terminal and wire size as per terminal vendor recommendations. The ground contact pins 12 are 0.110"×0.032" male tabs which are available from Ark-les Corp. under part number 3650M-19A, for example. The hot contact pins 12 are 0.109" diameter pins which are available from ETCO, Inc., part number PN109 HB or from Heyco Stamped Products, Inc., part number 7047. The ground receptacles 22 for female connector part 20 are 0.110"×0.032" quick connect terminals which are available from Ark-les Corp. as part number 3650H-103AB-2, or 3650H-124A-2, for example. The receptacle hot leads 22 are 0.109" diameter receptacle parts that are available from ETCO, Inc. under part number RED109-HB or from Heyco Stamped Products, Inc., as part number 7283, for example.

In addition to the above-mentioned terminal parts, any equivalent parts can be used. The male tabs and male pins, have a contact portion that extends exteriorly of rectilinear body 14, as can be seen in FIG. 1. Contact pins 12 also have a concealed end, which consists of a generally U-shaped configuration. The stripped wire lead is placed within the U-shaped configuration, and the free ends of the U are then crimped onto the wire lead.

The receptacle terminals, have a first open end for receiving the contact pins which are located just inside of rectilinear opening 24. The second end of the receptacles, has an open U-shaped configuration. The wire leads are placed within the U-shaped configuration and the free ends of the U are crimped closed to form an electrical connection to the wire.

Third, housings 13 and 23 are molded over the wire leads or cords using the same PVC molding compound. The molding process utilizes the insert molding method and insert molding injection machinery. A bead and a groove are molded onto corresponding male and female connector parts. The bead and groove can be placed on either the male or female connector part. The PVC molding compound is sold under the designation E 01 Black available from EC Polymer. The PVC molding compound has a hardness (shore DURO ±3) of A-86, according to ASTM D2240. Alternately, any PVC material having a hardness of A −80 (±2) may be used.

The molding compound has a specific gravity (±0.02) of 1.40 according to ASTM D792, and an ultimate tensile of 1800 according to ASTM D-412. The material has a 100% modulus of 900 and an elongation of 300, both according to ASTM D-412. The material has a low temperature brittleness of −15° C., according to ASTM D-746. Following oven aging for seven days, the material has an ultimate tensile of 1950, a 100% modulus of 1500, and an elongation of 240, all according to ASTM D-412. The percent of elongation retained is 80%.

Fourth, the product is tested to ensure the electrical performance. The final testing includes testing the polarization, continuity and die-electric properties of the connectors. Mechanical performance testing is also maintained throughout all of the manufacturing stages.

While only a single embodiment of the present invention has been shown and described, it is to be understood that many changes and modifications may be made thereunto without departing from the spirit and scope of the invention as defined in the appended claims.

What is claimed is:

1. A connector with fluid sealing between mated parts comprising:

a male connector part having a rectangular body containing at least one contact pin, an outer rectangular peripheral surface of said rectangular body forming a male mating area;

a female connector part, containing at least one contact receptacle, having a rectangular opening adapted to receive said male connector part within said opening, an inner rectangular peripheral surface of said female connector part defining said rectangular opening forming a female mating area, said rectangular peripheral surfaces and the location of said contact pins and contact receptacles limiting contact of said at least one contact pin and contact receptacle to a particular configuration; and a bead extending circumferentially around the rectangular periphery of one of said male and female mating areas, the other of said male and female mating areas having a groove extending circumferentially around the rectangular periphery adapted to receive said bead to create a fluid seal between said male and female connector parts.

2. The connector with fluid sealing according to claim 1, wherein said male and female connector parts are movable along a mating axis to connect and disconnect said at least one contact pin and said at least one contact receptacle, said male and female mating areas being oriented parallel to the mating axis.

3. The connector with fluid sealing according to claim 2, wherein said bead has a bead height measured transverse to said mating axis, and the groove has a groove depth which is approximately equal to said bead height.

4. The connector with fluid sealing according to claim 3, wherein said bead has a bead width measured parallel to said mating axis, and said groove has a groove width which is slightly larger than said bead width.

5. The connector with fluid sealing according to claim 4, wherein said male mating area has a male mating area length measured in a direction parallel to said mating axis, and said female mating area has a female mating area length which is approximately equal to said male mating area length.

6. The connector with fluid sealing according to claim 5, wherein said male mating area has an end facing said at least one contact receptacle, said fluid seal is located substantially away from said end.

7. The connector with fluid sealing according to claim 6, wherein said male mating area includes a first region located between said fluid seal and said end and a second region located on the opposite side of said fluid seal; said first region has a first region length measured in a direction parallel to said mating axis, and said second region has a second region length measured in a direction parallel to said mating axis that is less than half of said first region length.

8. The connector with fluid sealing according to claim 7, wherein said bead width is approximately 1½ times the bead height.

9. The connector with fluid sealing according to claim 8, wherein the first region length is approximately four times the bead width.

10. The connector with fluid sealing according to claim 9, wherein said groove width is approximately twice the length of said groove depth.

11. A method for manufacturing male and female connector parts for a connector with fluid sealing, comprising the steps of:

cutting wires to a specified length;

stripping a predetermined length of insulation from an end of each of the wires;

crimping terminals to the stripped wire ends;

molding a male connector part over some of the wires and terminals to form a rectangular body, the outer rectangular peripheral surfaces of said rectangular body forming a male mating area;

molding a female connector part over others of the wires and terminals to form a rectangular opening adapted to receive said rectangular body within said opening, the inner rectangular peripheral surfaces of said female connector part defining said rectangular opening forming a female mating area;

molding a bead circumferentially around the rectangular periphery of one of said male and female mating areas; and molding a groove circumferentially around the rectangular periphery of the other of said male and female mating areas, the groove being adapted to receive said bead to create a fluid seal between said male and female connector parts.

12. The method according to claim 11, wherein said steps of molding include molding by insert molding with insert molding injection machinery.

13. The method according to claim 12, wherein said steps of molding a male connector part, molding a female connector part, and molding a bead include molding a polyvinyl chloride molding compound.

14. The method according to claim 13, additionally comprising the step of testing the polarization, continuity and die-electric characteristics of the connector, following said step of molding a groove.

* * * * *